United States Patent [19]

Sansom

[11] 4,417,412

[45] Nov. 29, 1983

[54] FIBER OPTIC DISPLAY DEVICE

[76] Inventor: William L. Sansom, 103 W. 27th St., New York, N.Y. 10001

[21] Appl. No.: 290,424

[22] Filed: Aug. 6, 1981

[51] Int. Cl.[3] ..... G09F 13/00

[52] U.S. Cl. ..... 40/547

[58] Field of Search ..... 40/547, 546, 614; 362/806, 32, 31

[56] References Cited

U.S. PATENT DOCUMENTS

| | | | |
|---|---|---|---|
| 2,507,909 | 5/1950 | Kaysen | 40/547 |
| 2,639,528 | 5/1953 | Ochsner | 40/547 |
| 3,184,872 | 5/1965 | Way | 40/547 |
| 3,431,410 | 3/1969 | Dolan et al. | 40/614 X |

*Primary Examiner*—Gene Mancene
*Assistant Examiner*—Wenceslao J. Contreras

[57] ABSTRACT

A display device includes a plurality of optical fiber elements which are bunched together at one end adjacent a light source. The light emitting ends of the optical fiber elements pass through apertures in a moveable panel. The apertures may be arranged into a desired configuration and, in part, serve as locators for the light emitting ends of the optical elements. The moveable panel is moveable to a first position proximate the light emitting ends of the optical fiber elements, and where so positioned, the ends of the optical fiber elements are moved to substantially conform to the pattern of the apertures in the moveable panel to present an illuminated display substantially the same as the aperture pattern. The moveable panel is then moveable to a second position in which it is displaced from the light emitting ends of the optical fiber elements, and when so positioned the ends of the optical fibers move to form a second image distinct from the first. The moveable panel may be moved from the first to the second positions repeatedly to create a display in which the light emitting ends forming the first image are oriented by the movement of the panel into a second image.

6 Claims, 8 Drawing Figures

FIBER OPTIC DISPLAY DEVICE

BACKGROUND OF THE INVENTION

1. Field of the Invention

The invention relates to a display device utilizing optical fiber elements, and, more particularly, to a display device wherein images are formed by the specific orientation and disorientation of the light emitting ends of the optical fibers caused by a moveable panel.

2. Prior Art

It has long been recognized in the advertising and promotional fields that displays which present either a moving illuminated image or changing pictorial presentation are more effective than static constant image displays in attracting and maintaining the interests of an observer. In most conventional designs display devices of this type have required large numbers of separate light sources mounted at separate locations on display boards with each light source energized and deenergized in accordance with a complex control pattern.

Attempts have been made in the art to reduce, somewhat, the complexity of such display devices through the use of fiber optic elements as substitute for the separate light sources. For example, in U.S. Pat. No. 3,184,872, there is disclosed a moving pattern simulator having a plurality of lighting element locations to receive the ends of light conducting fiber elements, the other ends of the fiber elements being disposed adjacent a light source. Motion is imparted to a lighted pattern by controlling the sequence of illumination of fiber elements.

In these display devices utilizing fiber optics to form moveable images, such as the above referenced U.S. Pat. No. 3,184,872, the fiber optics remain stationary and the end of one fiber does not move relative to its counterpart in the adjacent fibers. With the fixed fiber end construction, the variation in the display is severely limited.

It is toward expansion of the ability of the prior art that the present invention is directed.

SUMMARY OF THE INVENTION

1. Purpose of the Invention

It is an object of the present invention to provide a display device in which images are formed by the specific orientation and disorientation of light emitting optical fiber ends caused by a moveable panel which results in an attractive eye-catching motion.

It is another object of the present invention to provide a display device which creates the visual effect of the elements of a fixed image exploding into a random pattern. It is another object of the present invention to provide a display device which is compact in structure and simple in operation.

Still yet another object of the present invention is to provide a display device capable of presenting the visual effect of the light emitting ends of optical fiber elements that form a specific image exploding into a random pattern and reforming the specific image.

Still other objects of the present invention in part will be obvious, and, in part will be apparent as the description proceeds.

2. Brief Description of the Invention

Generally, the above and other objects of the present invention are accomplished by providing a display device with a plurality of optical fiber elements each of which has one end positioned adjacent a source of illumination. The other end of each of the optical fiber elements passes through an aperture in a fixed panel. One or more optical fibers may pass through each aperture. The apertures in the fixed panel are arranged in a pattern to roughly conform to a fixed image in a moveable panel. The fibers continue through the fixed panel toward the front or display end of the device and pass through specific apertures in the moveable panel terminating at the other side. The pattern of the specific apertures in the moveable panel forms a specific image. The moveable panel is driven by a drive means into a first position in which it is proximate the other or light emitting ends of the optical fiber elememts. The drive means may be any combination of elements capable of displacing the moveable panel in a linear path toward and away from the fixed panel. When the moveable panel is so positioned, the light emitting ends of the optical fiber elements are moved into a configuration which conforms, substantially, to the pattern of apertures in the moveable panel to present an illuminated display substantially the same as the pattern in the moveable panel. The drive means is adapted to move the moveable panel from its most forward position i.e., furtherest away from the fixed panel closest to the light emitting ends into a position closest the fixed panel causing the fibers to splay into a random image. The drive means may then return the moveable panel to its first position to complete the cycle which may, thereafter, be repeated.

The invention consists of the features of construction and arrangement of parts which will be detailed hereinafter and described in the appended claims.

BRIEF DESCRIPTION OF THE DRAWINGS

While the specification concludes with claims paticularly pointing out and distinctly claiming the subject matter regarded as the invention herein, it is believed that the invention will be better understood from the following description when read in conjunction with the accompanying drawings, in which:

DESCRIPTION OF THE PREFERRED EMBODIMENTS

Figure 1:
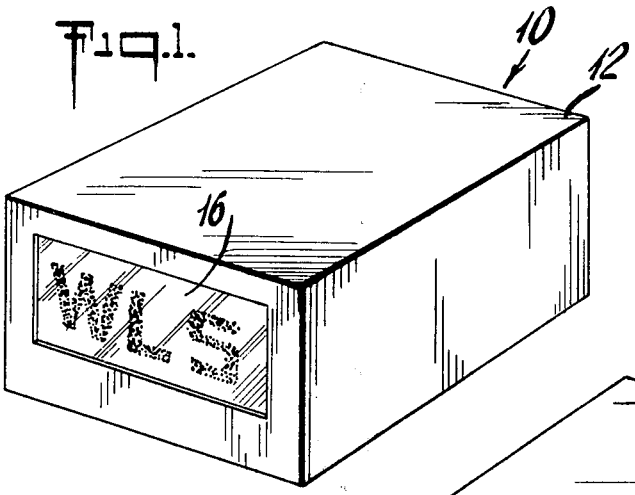
FIG. 1 is a perspective view of a display apparatus constructed in accordance with the present invention in which a selected illuminated image is presented.

Referring now to the drawings, there is represented in FIG. 1 a display apparatus constructed in accordance with the present invention identified generally by the reference numeral 10. The display apparatus 10 includes a housing 12 constructed and arranged to contain an image forming means 14 described hereinafter in detail. A display window 16 is provided in the housing in which the images to be formed are viewable by an observer. While the housing 12 is shown as a basically rectanguloid structure, it is to be particularly understood that this particular configuration for housing is not critical to the present invention. Indeed, the housing 12 may be of a circular, square, or triangular configuration or any other configuration which is aesthetically pleasing and attractive as a display device. Likewise the particular materials from which the housing is constructed are not important and any materials regularly utilized in the art may be employed.

Figure 3A:
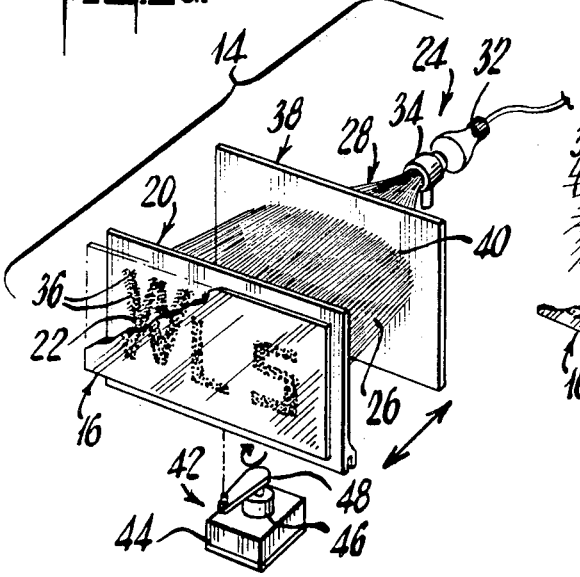
FIG. 3 is an enlarged, partially schematic view of the illumination and image forming system in accordance with the present invention.
Figure 3B:
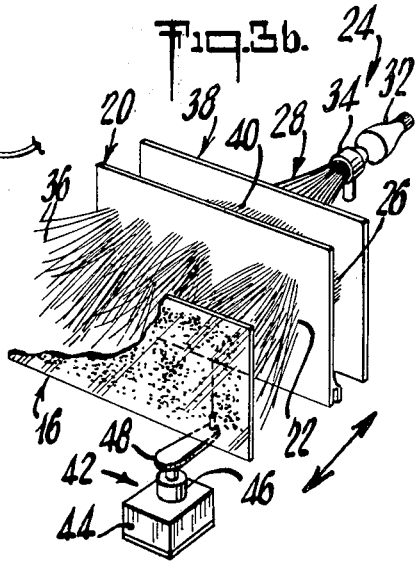
Figure 4:
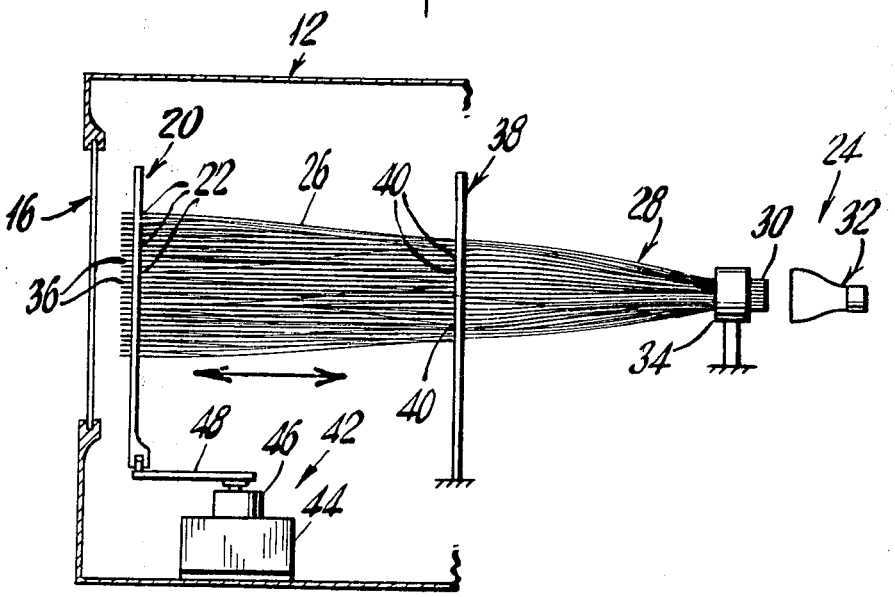
FIGS. 4 and 5 are elevational views taken in the direction of arrow 4 of FIG. 3, showing the positioning of the image forming panel in its first and second positions respectively.
Figure 5:
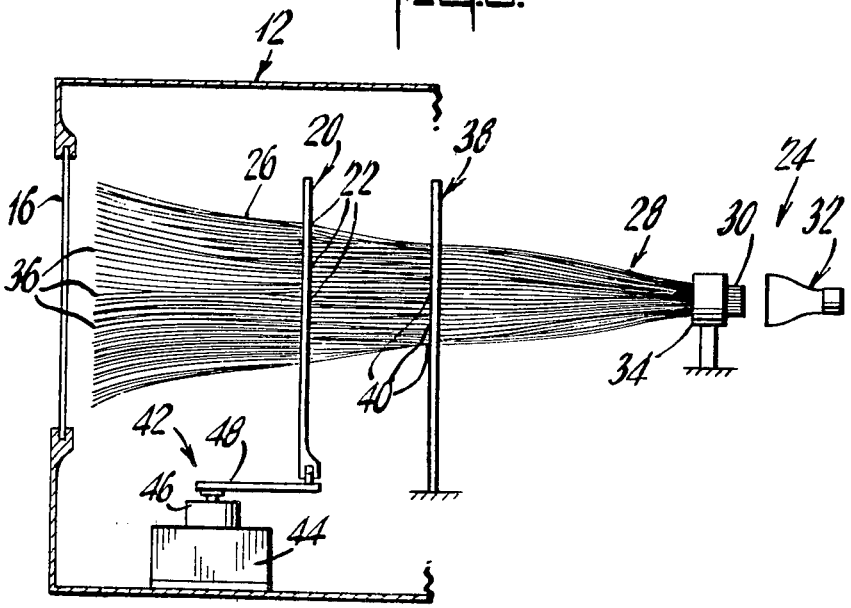

The construction and operation of the image forming means 14 can best be understood with reference to FIGS. 3,4, and 5 wherein the image forming means is shown as including a moveable support member or panel 20 having a large number of apertures 22 therein, arranged in a preselected pattern which represents, substantially, one image to be formed in the display.

The image forming means 14 is shown in detail in FIG. 3 and includes an illumination means identified generally by reference numeral 24 which includes a plurality of optical fiber or light conducting elements 26 and a source of illumination. The optical fibers 26 are grouped together at their one end 28 to form a bundle 30 which is positioned adjacent a light source 32. A support 34 may be provided to securely tighten the bundle 30 and maintain it in fixed relationship to the light source 32. The other end 36 of each of the optical fiber elements 26 is inserted through an aperture 22 in the panel 20. Preferably, only one optical fiber end 36 is located whthin each aperture 22. As will become apparent as the description proceeds the apertures are dimensioned so that the ends of the optical fibers may pass freely therthrough. The ends are not frictionally engaged in the panel 20, nor are they afixed thereto by means of fasteners, the fibers are commonly made of plastic and come into limited contact with the walls of the apertures, glue or other adhesive means.

A fixed supplemental support panel 38, having apertures 40 therethrough, may be provided between the moveable panel 20 and the bundle 30 to aid in supporting and positioning the optical fibers with respect to the moveable panel 20. The optical fibers 26 pass through the apertures 40 and may be frictionally retained therein, or otherwise held stationary in the apertures 40. Each optical fiber 26 may pass through a separate aperture 40, or if desired, more than one optical fiber may pass through an aperture 40. The apertures 40 form a pattern different from the pattern of the apertures 22.

The optical fiber elements 26 are well known to those skilled in the art. Indeed, in the above mentioned U.S. Pat. No. 3,184,872 there is a pertinent discussion of the characteristics of the optical fibers suitable for use in the present invention. Basically, each of the optical fibers is made of a highly transparent material which is flexible to permit the creation of various images as will be described below. Clear plastics such as styrene and methmethacrylate are suitable for this purpose as commonly known in the art. To prevent loss of light, the optical fiber conductors must have a higher refractive index than the surrounding medium. The fiber elements 26 may, of course, be of various sizes depending on the size and use of the display device in which they are installed. Generally, they will range from about 1/16 inch to ½ inch in diameter.

As noted hereinabove, the panel 20 is moveable within the housing, and it is this movement of the panel 20 with respect to the ends 36 of the optical fibers 26 which creates the various images in the display. With continued reference to FIGS. 4 and 5, a drive means 42 is provided to selectively move the panel 20 from a first position (FIG. 4) to a second position (FIG. 5) within the housing 12. The specific construction of the drive means 42 will be readily apparent to those skilled in the art and for the sake of brevity, is depicted symbolically as including a drive motor 44, gearing arrangement 46 and linkage 48. Guide means (not shown) may also be provided to control the path of the panel 20 within the housing.

When the panel 20 is in a first position, as shown in FIG. 4, the ends 36 of the optical fibers 26 which preferably, lie in the same plane, project a slight distance from or are proximate to the face of the panel 20. With the panel in this position, the pattern of the ends 36 of the optical fibers conforms substantially, to the pattern of the apertures 22 in the panel 20. For example, if the apertures 22 formed the pattern "WLS", then, with the panel 20 in the first position, the ends 36 of the optical fibers would conform to the "WLS" configuration. An observer of the display apparatus 10 with the panel in this position would see the illuminated "WLS" letter image in the display window 16 (See FIG. 1). Obviously, the invention lends itself to various other patterns, and it should be particularly understood that it is not limited to the pattern "WLS" with the panel in the first position.

Figure 2:
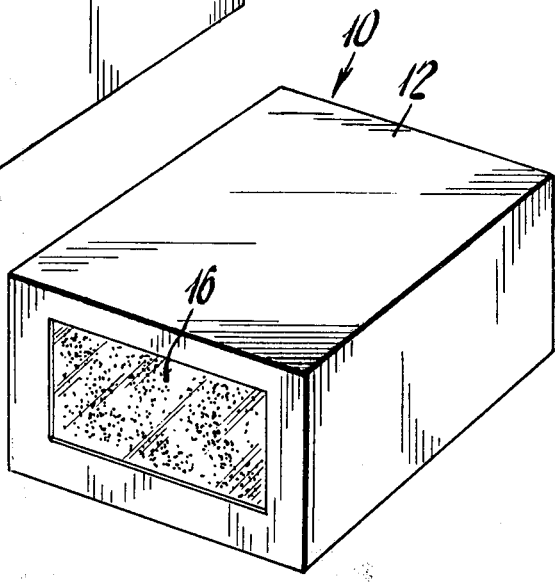
FIG. 2 is a perspective view of the apparatus shown in FIG. 1 wherein an illuminated random image is presented.

The panel 20 can then be moved by the drive means 42 into its second position (FIG. 5) wherein it is spaced from the ends 36 of the optical fibers and brought closer to the fixed panel 38 than in its first position. As noted hereinabove, the optical fibers 26 are formed from a flexible material and the fibers will bend slightly as the panel 20 moves to its second position. The light emitting ends of the fibers now form an expanded randomized image. An observer would see the image of FIG. 1 apparently exploding into the random image displayed in FIG. 2.

The drive means 42 may be cyclical and will move the panel 20 back to its first position in which the randomly oriented ends 36 are supported and guided by the panel 20 to reform the first image, i.e., the "WLS" image from the random image pattern.

If the suplemental support panel 38 is provided, the apertures 40 therein are spaced differently from the apertures 22 in the panel 20 so that as the panel 20 approaches the panel 38, the difference in the aperture spacing will force the fiber ends still further from the original image.

It can thus be seen that the objects of the present invention namely, to provide a display device in which images are formed by the specific orientation and disorientation of the light emitting ends of the optical fibers has been accomplished by a display device having a plurality of optical fiber elements which are bunched together at one end adjacent a light source. The light emitting ends of the optical fiber elements pass through apertures in a moveable panel which are arranged into a desired configuration and, in part, serve as locaters for the free ends of the optical fibers. The moveable panel is moveable to a first position proximate the light emitting ends of the optical fiber elements, and where so positioned, the ends of the optical fiber elements are moved to substantially conform to the pattern of the apertures in the member to present an illuminated display substantially the same as the aperture pattern. The panel is then moveable to a second position in which it is displaced from the light emitting ends of the optical fiber elements, causing the light emitting ends of the optical fibers to orient themselves into a random pattern image distinct from the first. The panel may be moved from the first to the second positions repeatedly to create a display in which the first image appears to explode into the random second image and then reforms.

While in accordance with the patent statutes, a preferred embodiment has been described in detail, it is to be understood that the invention is not limited thereto or thereby.

What is claimed is:

1. A fiber optic display device comprising:

(a) a plurality of flexible elongated optical fiber elements each of said optical fiber elements having a light receiving end and a light emitting end;

(b) a source of illumination constructed and arranged to illuminate said light receiving ends of said optical fiber elements; and (c) image forming means constructed and arranged to place said light emitting ends of said optical fiber elements into two or more image displays including:

(i) a moveable panel member provided with a plurality of apertures therethrough, said aperatures being in a pattern substantially corresponding to a first image to be displayed said optical fibers freely passing through said aperatures; and (ii) displacement means constructed and arranged to move said panel member between a first position proximate the light emitting ends of said optical fiber elements whereby said light emitting ends of said optical fiber elements conform substantially to the pattern of said aperatures in said panel and a second position wherein said panel members is spaced from said light emitting ends in the direction of said light receiving ends whereby said light emitting ends of said flexible optical fiber elements, conform to a second image pattern.

2. The fiber optic display device in accordance with claim 1 wherein said second image is formed by said light emitting ends in a randomly dispersed arrangement.

3. The fiber optic display device in accordance with claim 1 wherein each of said light emitting ends of said optical fibers passes through a separate aperture in said panel.

4. The fiber optic display device in accordance with claim 1 further including a stationary support member oonstructed and arranged to support said optical fiber elements positioned between said moveable panel member and said light receiving ends of said optical fiber elements.

5. The fiber optic display device in accordance with claim 4 wherein said stationary support member is provided with a plurality of apertures therethrough, said optical fiber elements being fixedly positioned within said apertures.

6. The fiber optic display device in accordance with claim 5 wherein said apertures in said stationary support member are oriented in a pattern differing from the pattern of said apertures in said moveable panel member.

* * * * *